United States Patent [19]

Sando et al.

[11] Patent Number: 4,500,318

[45] Date of Patent: Feb. 19, 1985

[54] METHOD FOR DESIZING, SCOURING AND BLEACHING TEXTILE PRODUCT

[75] Inventors: Yoshikazu Sando; Eiichi Nakano; Hiroshi Ishidoshiro, all of Wakayama, Japan

[73] Assignee: Sando Iron Works Co., Ltd., Tokyo, Japan

[21] Appl. No.: 521,709

[22] Filed: Aug. 9, 1983

[30] Foreign Application Priority Data

Aug. 10, 1982 [JP] Japan ..... 57-138795

[51] Int. Cl.[3] ..... D06L 3/02; D06L 3/04; D06L 1/06; D01C 3/02

[52] U.S. Cl. ..... 8/111; 8/138

[58] Field of Search ..... 8/111, 138

[56] References Cited

FOREIGN PATENT DOCUMENTS 2916600 10/1979 Fed. Rep. of Germany ..... 8/111

54-27098 3/1979 Japan ..... 8/111

*Primary Examiner*—Maria Parrish Tungol

*Attorney, Agent, or Firm*—Toren, McGeady and Stanger

[57] ABSTRACT

A method for desizing, scouring and bleaching a textile product, in which a natural cellulose-type textile product is soaked with a neutral aqueous hydrogen peroxide solution, steamed in a saturated water vapor atmosphere at 120° C. to 160° C., soaked immediately with a hot caustic soda solution without cooling and washing under the same saturated water vapor, and steamed again in a saturated water vapor atmosphere at 120° C. to 160° C.

3 Claims, No Drawings

METHOD FOR DESIZING, SCOURING AND BLEACHING TEXTILE PRODUCT

BACKGROUND OF THE INVENTION

The present invention relates to a method for subjecting a natural cellulose-type textile product or a natural cellulose-containing textile product to pretreatment, i.e., to desizing, scouring and bleaching under wet-heat.

For the rationalization of the pretreatment of natural cellulose-type textile products in recent years, it is required to spare energy and resources such as the treating agent and manpower, to simplify the treating process and to speed up the treatment. For elevating the quality of the product, on the other hand, a high pressure steamer has been developed to treat a textile product continuously under wet-heat at high temperature and pressure by using a high pressure steamer.

The standard process for desizing, scouring and bleaching a textile by utilizing a conventional high pressure steamer is a two-bath two-stage method, in which a textile product to be treated is soaked with a treating solution containing 60 to 100 g/l of caustic soda, 10 to 20 g/l of an oxidative desizing agent and 10 to 15 g/l of a scouring agent at the ordinary temperature steamed for 60 seconds in a saturated water vapor atmosphere at a temperature from 130° to 150° C. under pressure, cooled and washed well, soaked with an aqueous alkaline hydrogen peroxide solution at pH 11–12 containing 40 to 80 cc/l of 35% hydrogen peroxide, 5 g/l of caustic soda, 10 g/l of a hydrogen peroxide stabilizer and a metal ion sequestering agent at the ordinary temperature, and then steamed again for 60 seconds in a saturated water vapor atmosphere at a temperature from 120° to 125° C. On the other hand, the general procedure for a one-bath one-stage method comprises applying an aqueous strongly alkaline hydrogen peroxide solution containing 10 to 30 g/l of caustic soda, 10 to 20 g/l of an oxidative desizing agent, 40 to 70 g/l of 35% hydrogen peroxide, 10 to 20 g/l of a scouring agent, 10 g/l of a hydrogen peroxide stabilizer and 5 g/l of a metal ion sequestering agent, and steaming the textile product in a saturated water vapor atmosphere at 130° to 140° C.

However, in the former case, after the desizing and scouring with the use of caustic soda, oxidative desizing agent and scouring agent and the washing thereof, bleaching must be done with the use of alkaline hydrogen peroxide solution. Thus, the treatment must be done uneconomically in two stages. The latter instance can be done in one stage, but, since caustic soda, oxidative desizing agent and hydrogen peroxide are used in one bath, there is a problem in the pH of the treating solution, and the effects of the treating agents are offset with one another before the agents act on the textile product, causing the wastefullness of the treating agents, deteriorating the treating effecfs on dewaxing, denepping and decolorization, and weakening the strength of the product.

SUMMARY OF THE INVENTION

Under such circumstances, the present inventors studied on the improvement of the method for pretreating a textile product (cloth) with the use of a high pressure steamer, and succeeded in the present invention to simplify the process with the use of a minimum amount of treating agent and to produce an excellent and uniform product with excellent desizing, dewaxing, denepping and bleaching effects.

The present inventive method is characterized in that a natural cellulose-type textile product or a natural cellulose-containing textile product is soaked with a neutral aqueous hydrogen peroxide solution, steamed in a saturated water vapor atmosphere at a temperature in the range of from 120° to 160° C., soaked immediately with a hot caustic soda solution under the same saturated water vapor without cooling and washing, and steamed again in a saturated water vapor atmosphere at a temperature in the range of from 120° to 160° C.

The process is of a so-called two-bath one-stage type, and the effect is quite distinguished.

DETAILED DESCRIPTION OF THE PREFERRED EMBODIMENT

The preferred embodiments of the present invention will be described in detail in the following.

At first, the textile product (cloth) to be treated, i.e., a natural cellulose-type cloth or a natural cellulose-containing cloth, is soaked with a neutral aqueous hydrogen peroxide solution, and then the resultant cloth is steamed in a saturated water vapor atmosphere at a temperature in the range of from 120° to 160° C. In steaming a cloth soaked with a commonly applied hydrogen peroxide solution in an alkaline region at a temperature as high as 120° to 160° C. under pressure, the decomposition proceeds too fast, and its reaction with the cloth proceeds only at the surface of the cloth, leaving the interior thereof unreacted. On the contrary, however, in the case of a neutral hydrogen peroxide solution as in the case of the present invention, while the reaction proceeds only slowly in the treatment at a temperature below 100° C. under the ordinary pressure, when steaming is done at a high temperature in the range of from 120° to 160° C. under pressure, hydrogen peroxide reacts with the cloth up to the interior thereof sufficiently in a very short period of 5 to 20 seconds, and a part of the sizing agent, waxes and nep coloring matters are solubilized thereby.

Thus treated cloth is immediately soaked with a hot caustic soda solution at a temperature from 120° to 160° C. without cooling and washing, and steamed again at this temperature. Then, unreacted hydrogen peroxide adhering to the cloth reacts suddenly and completely to solubilize the remaining impurities such as sizing agent, waxes and nep coloring matters. The solubilized impurities can be removed in the subsequent washing step, and thus uniform desizing, scouring and bleaching of a cloth can be done eminently.

Suitable range of the concentration of hydrogen peroxide in the neutral solution is from 5 to 40 cc/l (desirably from 10 to 25 cc/l), the steaming time is suitably from 5 to 20 seconds, suitable concentration of caustic soda is from 10 to 40 g/l (or desirably from 15 to 30 g/l), and the steaming time is from 30 to 60 seconds. Textile products to be applied to the present invention is of 100% cotton or hemp, or blended fabric of cotton, hemp and polyester.

In determining the suitable steaming temperatures in hydrogen peroxide and caustic soda treatments in the present invention, the result was as shown in Table 1. From the result, it is obvious that the steaming temperature is to be in the range of from 120° to 160° C. in both instances.

TABLE 1

| | Steaming Time | | | Scouring (Dye Rising | Whiteness |
|---|---|---|---|---|---|
| | $H_2O_2$ (sec.) | NaOH (sec.) | Desizing Effect | Height) (mm) | (Hunter, Blue) (%) |
| 110° C. | 20 | 60 | inferior | 10 | 66.0 |
| 115° C. | 20 | 60 | inferior | 33 | 74.3 |
| 120° C. | 20 | 60 | good | 97 | 82.8 |
| 130° C. | 20 | 60 | good | 124 | 82.8 |
| 140° C. | 15 | 60 | good | 150 | 82.9 |
| 150° C. | 15 | 60 | good | 150 | 83.5 |
| 160° C. | 15 | 30 | good | 143 | 83.0 |

To clarify the effect of the present invention more distinctly, conventional desizing, scouring and bleaching methods and the present inventive desizing, scouring and bleaching method will be compared in the following with reference to the examples in the practical experiment.

(a) CONVENTIONAL EXAMPLE 1

A 100% cotton heavy weight fabric on the market having many neps was soaked with an aqueous solution containing 80 g/l of NaOH, 10 g/l of $Na_2S_2O_8$, 10 g/l of Scourroll TS 296 (a scouring agent manufactured by Kawo Atlas K.K.) at the ordinary temperature, squeezed with a squeezing mangle to control the solution content to 65%, steamed for 60 seconds in a high pressure steamer maintained with saturated water vapor at 140° C., and then washed and dried to complete the treatment. The treatment belongs to a one-bath one-stage process with the use of only caustic alkaline solution.

(b) CONVENTIONAL EXAMPLE 2

A 100% cotton fabric the same as in the above Example was soaked with an aqueous solution containing 50 cc/l of 35% hydrogen peroxide, 20 g/l of NaOH, 20 g/l of $Na_2S_2O_8$, 10 g/l of Scourroll TS 296, 10 g/l of RSB 100 (a hydrogen perioxide stabilizer manufactured by Rakuto Kasei K.K.) and 5 g/l of RSG 2000 (a metal ion sequestering agent manufactured by Rakuto Kasei K.K.) at ordinary temperatures, squeezed with a squeezing mangle to control the solution content to 65%, steamed for 60 seconds in a high pressure steamer maintained with saturated water vapor at 135° C., and then washed and dried to complete the treatment. The treatment belongs to a one-bath one-stage process with the use of a solution containing hydrogen peroxide and caustic alkali.

(c) CONVENTIONAL EXAMPLE 3

A 100% cotton fabric the same as in the above Examples was soaked with an aqueous solution containing 80 g/l of NaOH, 10 g/l of $Na_2S_2O_8$ and 10 g/l of Scourroll TS 296 at ordinary temperature, squeezed with a squeezing mangle to control the solution content to 65%, steamed for 60 seconds in a high pressure steamer maintained with saturated water vapor at 140° C. and then, cooled and washed. The fabric was further soaked with an aqueous solution containing 50 cc/l of 35% $H_2O_2$, 5 g/l of NaOH, 10 g/l of RSB 100, 5 g/l of RSG 2000 at the ordinary temperature, squeezed with a squeezing mangle to control the solution content to 60%, steamed again for 60 seconds in a high pressure steamer maintained with saturated water vapor at 120° C., and then washed and dried to complete the treatment. The treatment belongs to a two-bath two-stage process with the use of a caustic alkaline solution and a hydrogen peroxide solution.

(d) PRESENT INVENTIVE EXAMPLE

A 100% cotton heavy weight fabric on the market having many neps as in the above was soaked with an aqueous solution containing 20 cc/l of 35% $H_2O_2$ and 2 g/l of Scourroll TS 296 at the ordinary temperature, squeezed with a squeeze mangle to control the solution content to 60%, steamed for 15 seconds in a high pressure steamer maintained with saturated water vapor at 140° C., soaked further with an aqueous solution containing 20 g/l of NaOH and 3 g/l of Scourroll TS 296 in a hot liquid tank provided in the high pressure steamer, squeezed with a suitable squeezing means provided in the steamer to control the solution content to 120%, steamed again for 60 seconds in a saturated water vapor atmosphere at 140° C., and then washed and dried to complete the treatment. The treatment belongs to a two-bath one-stage process.

To compare the treating effects, i.e., the effects of desizing, scouring and bleaching in the conventional Examples and in the present inventive Example in the above, the results were as shown in Table 2.

TABLE 2

| Example | Desizing (Iodine Reaction) | Neps Remaining (naked eye) (%) | Wax Remaining (%) | Dye Rising Height (mm) | Whiteness (Hunter. Blue) (%) |
|---|---|---|---|---|---|
| Present Inventive | 0 | 0 | 0.35 | 150 | 82.9 |
| Conventional 1 | 0 | 30-40 | 0.60 | 60 | 55.5 |
| Conventional 2 | 0 | 5-10 | 0.64 | 40 | 65.7 |
| Conventional 3 | 0 | 0 | 0.42 | 100 | 85.6 |

As obvious from Table 2, the present invention has remarkably excellent effects, particularly in scouring and bleaching.

With the use of the present inventive method for desizing, scouring and bleaching a textile product, it is possible to simplify the process, to spare the use of treating agents to a minimum amount and to produce a product excellent in desizing, dewaxing, denepping and bleaching far beyond the conventional processes.

What we claim:

1. A method for desizing, scouring and bleaching a textile product, which comprises soaking a natural cellulose-type textile product with a neutral aqueous hydrogen peroxide solution, steaming the soaked product in a saturated water vapor atmosphere at 120° to 160° C., soaking the steamed product immediately with a hot caustic soda solution in a saturated water vapor atmosphere at 120° to 160° C. and steaming the soaked product again in a saturated water vapor atmosphere at 120° to 160° C.

2. A method, as set forth in claim 1, including the steps of soaking the textile product in an aqueous solution containing 20 cc/l of 35% $H_2O_2$ and 2 g/l of a scouring agent at ordinary temperature, squeezing the textile product to control the solution content to 60%, steaming the textile product for 15 seconds with the saturated water vapor at 140° C., soaking the textile product with an aqueous solution containing 20 g/l of NaOH and 3 g/l of Scourroll TS 296, squeezing the textile product to control the solution content to 120%, and steaming the soaked product for 60 seconds in a saturated water vapor atmosphere at 140° C.

3. A method, as set forth in claim 2, including the step of washing and drying the textile product after it is soaked with the hot caustic soda solution and steamed.

* * * * *